US006912743B1

(12) United States Patent
Weil

(10) Patent No.: US 6,912,743 B1
(45) Date of Patent: Jul. 5, 2005

(54) BED DEVICE

(76) Inventor: Frances R. Weil, 133 Elkins Lake, Huntsville, TX (US) 77340

( * ) Notice: Subject to any disclaimer, the term of this patent is extended or adjusted under 35 U.S.C. 154(b) by 0 days.

(21) Appl. No.: 10/358,717

(22) Filed: Feb. 5, 2003

(51) Int. Cl.[7] ..... A47D 7/00
(52) U.S. Cl. ..... 5/93.1; 5/655; 5/425; 5/732
(58) Field of Search ..... 5/93.1, 655, 424, 5/425, 427, 945, 946, 732

(56) References Cited

U.S. PATENT DOCUMENTS

| | | | | | |
|---|---|---|---|---|---|
| 1,738,411 | A | * | 12/1929 | Welch | 5/655 |
| 2,626,407 | A | * | 1/1953 | Kurry | 5/99.1 |
| 3,729,752 | A | * | 5/1973 | Huggins | 5/93.1 |
| 4,583,253 | A | * | 4/1986 | Hall | 5/94 |
| 4,607,402 | A | * | 8/1986 | Pollard | 5/425 |
| 4,754,509 | A | * | 7/1988 | Pollard | 5/425 |
| 4,873,734 | A | * | 10/1989 | Pollard | 5/425 |
| 4,980,937 | A | | 1/1991 | Mason et al. | |
| 5,261,133 | A | | 11/1993 | Wilkerson | |
| 5,341,530 | A | * | 8/1994 | Ward | 5/93.1 |
| 5,699,569 | A | | 12/1997 | Schwarz-Zohrer | |
| 5,813,066 | A | * | 9/1998 | Gebhard et al. | 5/655 |
| 5,822,817 | A | * | 10/1998 | Carew et al. | 5/732 |
| 5,930,854 | A | * | 8/1999 | O'Neill et al. | 5/655 |
| 5,937,465 | A | * | 8/1999 | Carew et al. | 5/732 |
| 6,505,366 | B1 | * | 1/2003 | Lied | 5/655 |
| 6,848,128 | B2 | * | 2/2005 | Verbovszky et al. | 5/93.1 |
| 2005/0005362 | A1 | * | 1/2005 | Verbovszky | 5/655 |

FOREIGN PATENT DOCUMENTS

DE 4024807 A1 * 2/1992 ..... A47C 27/08

* cited by examiner

*Primary Examiner*—Robert G. Santos

(57) ABSTRACT

A the bed device for soothing an infant while the infant is resting. The the bed device includes a base member being designed for being positioned in the crib. The base member is designed for supporting the infant when the infant is placed on the base member. A side wall upwardly extends from the base member. The side wall and the base member define a receiving space. The receiving space is designed for receiving the infant when the infant is placed on the base member whereby the side wall is positioned around the sides of the infant to provide the infant with sense of security when the infant is sleeping.

1 Claim, 3 Drawing Sheets

BED DEVICE

BACKGROUND OF THE INVENTION

1. Field of the Invention

The present invention relates to infant supports and more particularly pertains to a new the bed device for soothing an infant while the infant is resting.

2. Description of the Prior Art

The use of infant supports is known in the prior art. U.S. Pat. No. 5,699,569 describes a device for supporting a child while sitting or sleeping. Another type of infant support is U.S. Pat. No. 5,261,133 having a device for receiving a prematurely born infant for positioning the infant a more natural position when the infant is resting. U.S. Pat. No. 4,980,937 has an infant sitting support and head protection ring that receives a child in a sitting position and supports the infant in the sitting position while cushioning the head of the infant should the infant fall against the ring.

SUMMARY OF THE INVENTION

An object of the present invention is to provide a new the ed device that provides a confined area for the infant to sleep in so that the infant feels as if the infant is resting in the enclosed space of the womb of the mother.

Even still another object of the present invention is to provide a new the bed device that eases the transition of the infant from the womb into more open spaces.

To this end, the present invention generally comprises a base member being designed for being positioned in the crib. The base member is designed for supporting the infant when the infant is placed on the base member. A side wall upwardly extends from the base member. The side wall and the base member define a receiving space. The receiving space is designed for receiving the infant when the infant is placed on the base member whereby the side wall is positioned around the sides of the infant to provide the infant with sense of security when the infant is sleeping.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
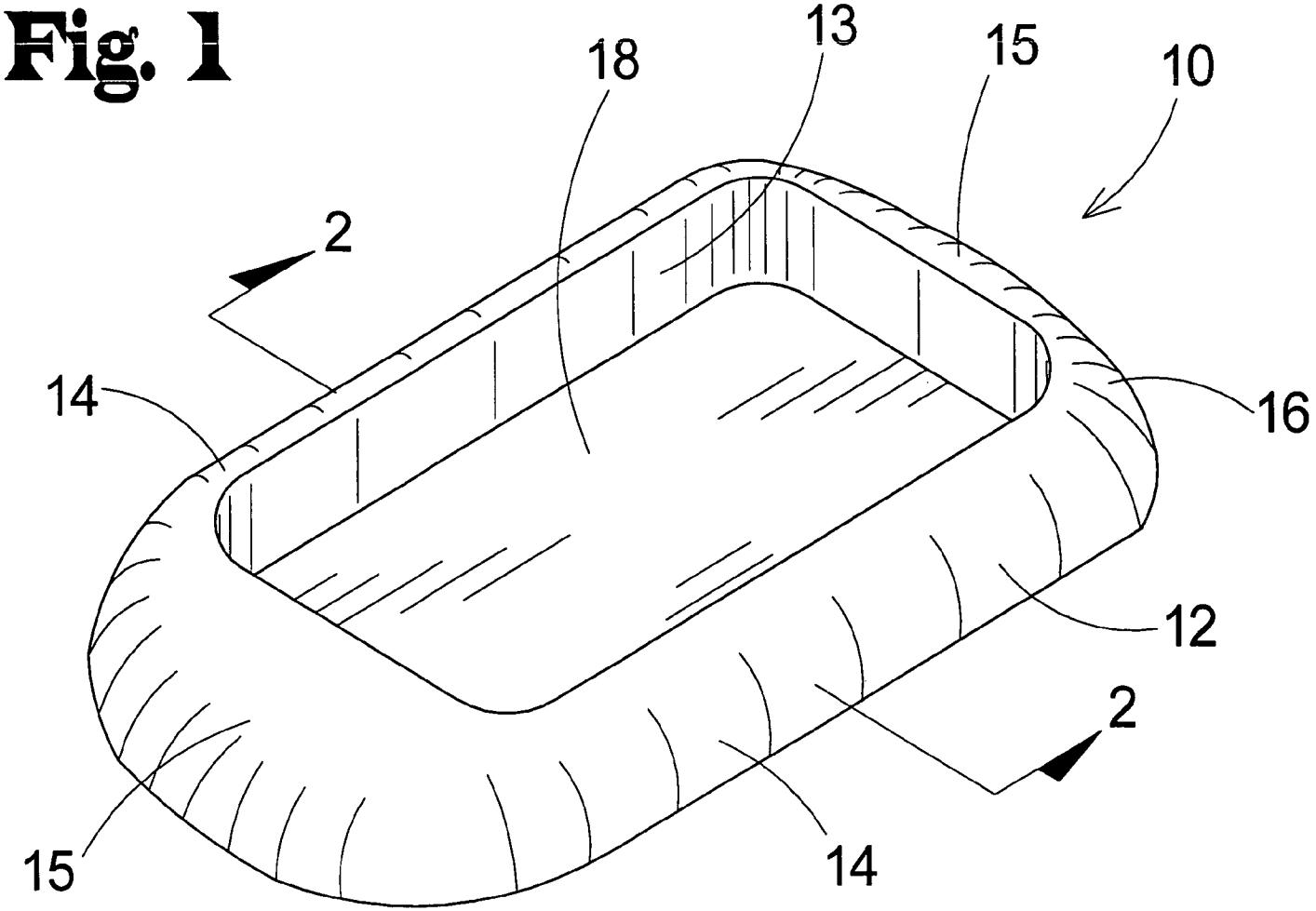
FIG. 1 is a perspective view of a new the bed device according to the present invention.
Figure 2:
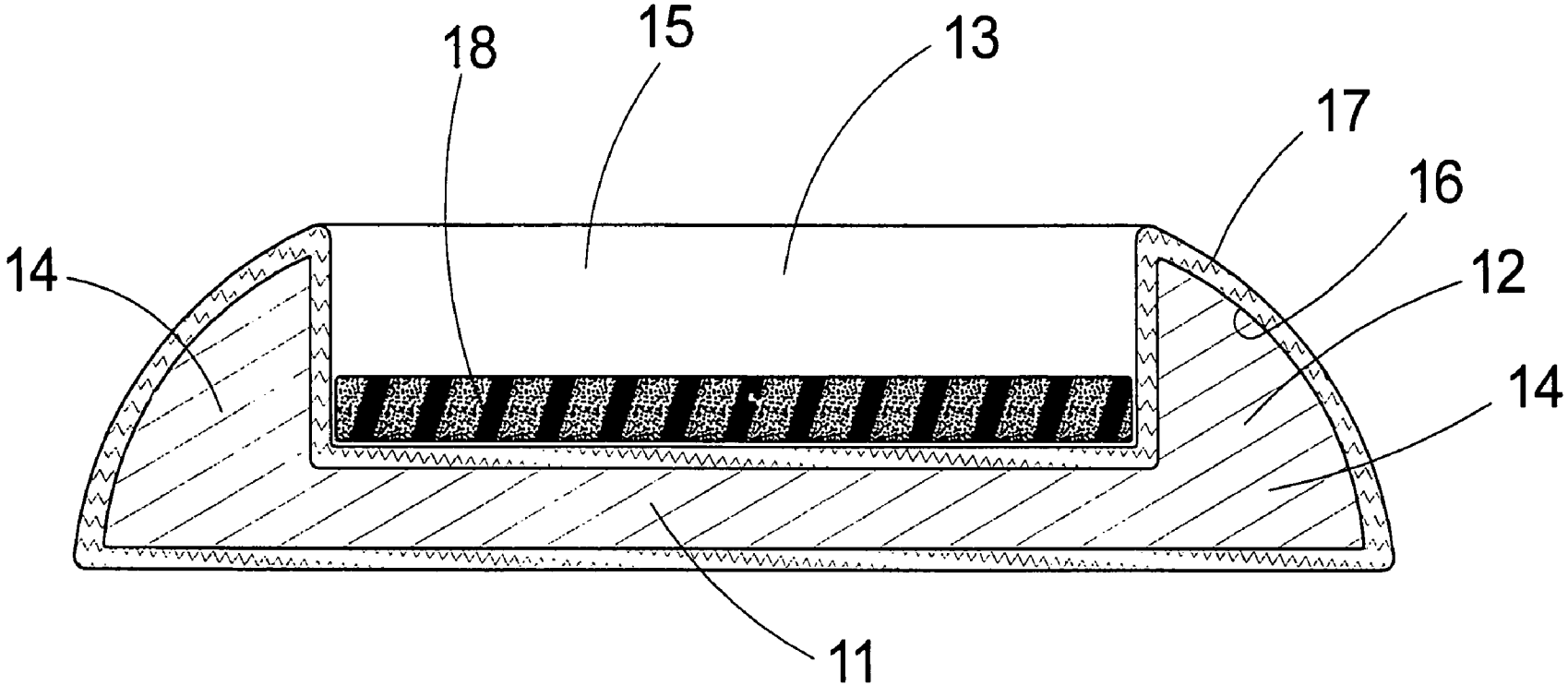
FIG. 2 is a cross-sectional view of the present invention taken along line 2—2 of FIG. 1.
Figure 3:
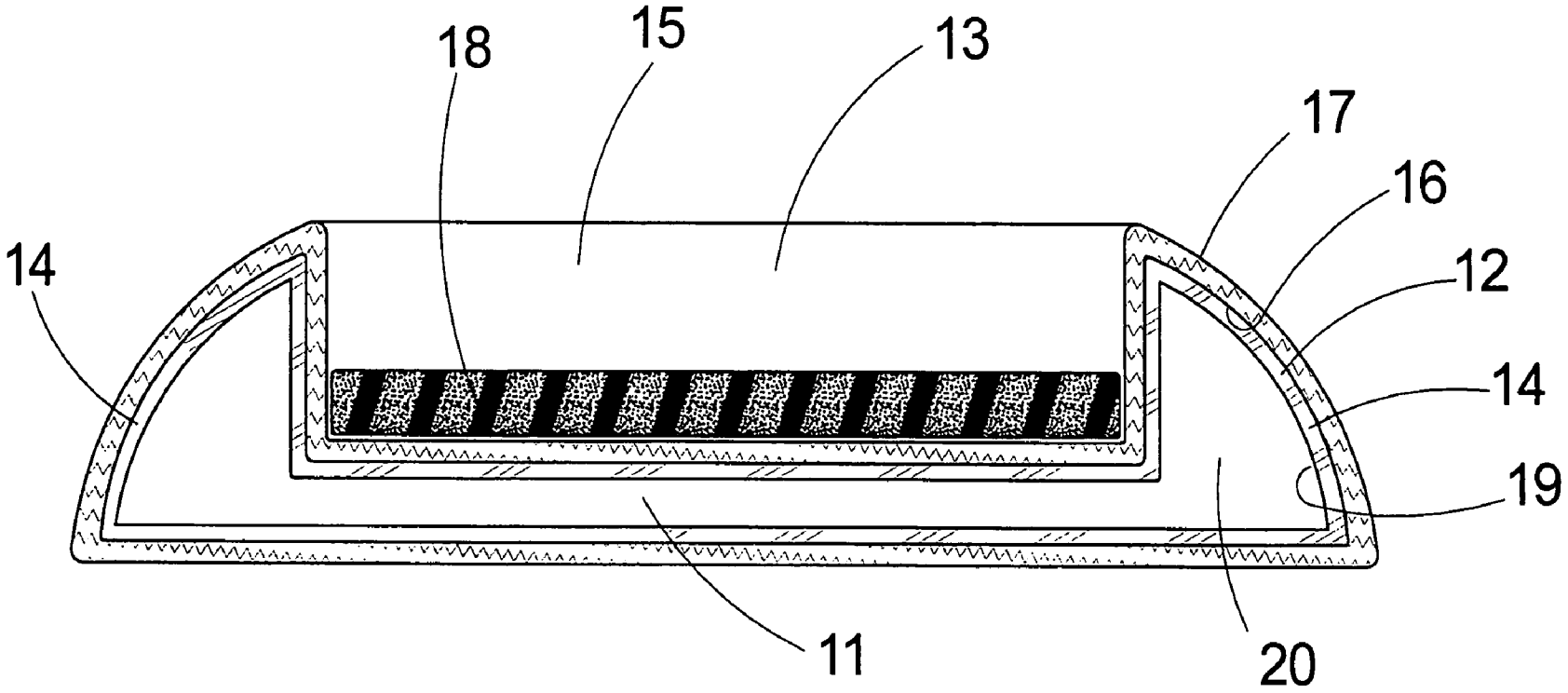
FIG. 3 is a cross-sectional view of an embodiment of the present invention.

With reference now to the drawings, and in particular to FIGS. 1 through 3 thereof, a new the bed device embodying the principles and concepts of the present invention and generally designated by the reference numeral 10 will be described.

As best illustrated in FIGS. 1 through 3, the the bed device 10 generally comprises a base member 11 being designed for being positioned in the crib. The base member 11 is designed for supporting the infant when the infant is placed on the base member 11.

A side wall 12 upwardly extends from the base member 11. The side wall 12 and the base member 11 define a receiving space 13. The receiving space 13 is designed for receiving the infant when the infant is placed on the base member 11 whereby the side wall 12 is positioned around the sides of the infant to provide the infant with sense of security when the infant is sleeping. The receiving space 13 has a depth of about 8 inches, a length of about 30 inches and a width of about 20 inches.

The side wall 12 comprises a pair of edge walls 14 and a pair of end walls 15. Each of the end walls 15 oppositely extends between the edge walls 14. The edge walls 14 and the end wall define the receiving space 13.

The side wall 12 comprises an exterior surface 16. The exterior surface 16 of the side wall 12 is substantially arcuate whereby the exterior surface 16 is designed for inhibiting damage when impacted by a user.

A cover member 17 is positioned over the side wall 12 and the base member 11. The cover member 17 is designed for abutting the skin of the infant whereby the cover member 17 is for providing a non-irritating surface for the infant to rest on. The cover member 17 comprises a fabric material. The fabric material is designed for providing a soothing feeling to the infant when the infant is positioned in the receiving space 13.

An insert member 18 is selectively positioned in the receiving space 13. The insert member 18 is positioned against the base member 11 whereby the insert member 18 is positioned between the base member 11 and the infant. The insert member 18 is designed for flexibly receiving the infant whereby the insert member 18 is for cushioning the infant when the infant is positioned in the receiving space 13. The insert member 18 comprises a compressible material. The compressible material is designed for compressing under the weight of the infant for cushioning the infant when the infant is positioned in the receiving space 13.

The base member 11 and the side wall 12 comprises a substantially rigid material. The rigid material maintains positioning of the side wall 12 with respect to the base member 11 when the base member 11 and the side wall 12 are being transported.

In an embodiment, as shown in FIG. 3, the base member 11 and the side wall 12 comprises an exterior wall 19. The exterior wall 19 defines an interior space 20. The exterior wall 19 is designed for maintaining a fluid in the interior space 20 whereby the exterior wall 19 defines the shape of the base member 11 and the side wall 12 when the fluid is positioned in the interior space 20.

In use, the user positions the base member 11 and the side wall 12 on the crib. The insert member 18 is then inserted into the receiving space 13 and the infant placed on top of the insert member 18. The insert member 18 cushions the infant and the cover member 17 provides a soothing surface for the infant when the infant is sleeping in the receiving space 13. The close proximity of the side wall 12 provides a comforting feeling to the infant as it imitates the close proximity of the mother's womb.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bed device for providing security for an infant placed in crib, the bed device comprising:

a base member being adapted for being positioned in the crib, said base member being adapted for supporting the infant when the infant is placed on said base member;

a side wall upwardly extending from said base member, said side wall and said base member defining a receiving space, said receiving space being adapted for receiving the infant when the infant is placed on said base member such that said side wall is positioned around the sides of the infant to provide the infant with sense of security when the infant is sleeping;

said side wall comprising a pair of edge walls and a pair of end walls, coach of said end walls oppositely extending between said edge walls, said edge walls and said end wall defining said receiving space;

said side wall comprising an exterior surface, said exterior surface of said side wall being substantially arcuate such that said exterior surface is adapted for inhibiting damage when impacted by a user;

a cover member being positioned over said side wall and said base member, said cover member being adapted for abutting the skin of the infant such that said cover member is for providing a non-irritating surface for the infant to rest on, said cover member being contiguous over an exposed face of said side wall and said base member exposed by said receiving space to inhibit access between said cover member, said side wall and said base member to inhibit the infant getting a portion of a body of the infant inadvertently trapped between said cover member, said side wall and said base member;

said cover member comprising a fabric material, said fabric material being adapted for providing a soothing feeling to the infant when the infant is positioned in said receiving space;

an insert member being selectively positioned in said receiving space, said insert member being positioned against said base member such that said insert member is positioned between said base member and the infant, said insert member being adapted for flexibly receiving the infant such that said insert member is for cushioning the infant when the infant is positioned in the receiving space;

said insert member comprising a compressible material, said compressible material being adapted for compressing under the weight of the infant for cushioning the infant when the infant is positioned in said receiving space; and said base member and said side wall comprising a substantially rigid material, said rigid material maintaining positioning of said side wall with respect to said base member when said base member and said side wall are being transported.

* * * * *